US010994895B2

(12) United States Patent
Hochberg et al.

(10) Patent No.: US 10,994,895 B2
(45) Date of Patent: May 4, 2021

(54) CONFORMABLE PACKAGE

(71) Applicant: The Procter & Gamble Company, Cincinnati, OH (US)

(72) Inventors: Scott David Hochberg, Cincinnati, OH (US); Michael Matthew Satkowski, Oxford, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/535,122

(22) Filed: Aug. 8, 2019

(65) Prior Publication Data

US 2020/0055635 A1 Feb. 20, 2020

Related U.S. Application Data

(60) Provisional application No. 62/718,406, filed on Aug. 14, 2018.

(51) Int. Cl.
*B65D 33/16* (2006.01)
*B65D 33/00* (2006.01)

(52) U.S. Cl.
CPC ..... *B65D 33/1616* (2013.01); *B65D 33/007* (2013.01); *B65D 2313/04* (2013.01)

(58) Field of Classification Search
CPC ..... B65D 33/1616; B65D 33/007; B65D 2313/04
USPC ..... 383/42
See application file for complete search history.

(56) References Cited

U.S. PATENT DOCUMENTS 3,968,898 A 7/1976 Beer
5,027,966 A 7/1991 Yadock
5,294,022 A 3/1994 Earle
5,424,703 A 6/1995 Blume, Jr.
(Continued)

FOREIGN PATENT DOCUMENTS

CN 2693663 Y 4/2005
CN 105644924 A 6/2016
(Continued)

OTHER PUBLICATIONS

International Search Report and Written Opinion dated Nov. 19, 2019, PCT/US2019/045594, 11 pgs.
(Continued)

*Primary Examiner* — Jes F Pascua
(74) *Attorney, Agent, or Firm* — Sarah M DeCristofaro

(57) ABSTRACT

A flexible package that can include first and second sidewalls. The first and second sidewalls being joined by a bottom portion and seams that define first and second sides. The package can have an opening opposite the bottom portion, a first plurality of magnetic regions, and a second plurality of magnetic regions. The first plurality of magnetic regions can be disposed on the first sidewall near the opening and include discrete magnetic regions. A second plurality of magnetic regions can be disposed on the second sidewall near the access opening and include opposed discrete magnetic regions. The second plurality of magnetic regions being opposite the first plurality of magnetic regions. The discrete magnetic regions and the opposed discrete magnetic regions can be magnetically engageable with a magnetic force to close the opening of the package in a configuration having M petals, where M is an integer from 2 to 8.

18 Claims, 5 Drawing Sheets

(56) References Cited

U.S. PATENT DOCUMENTS

| | | | | |
|---|---|---|---|---|
| 5,428,332 | A | 6/1995 | Srail | |
| 5,505,305 | A * | 4/1996 | Scholz | A61F 13/041 206/438 |
| 6,397,560 | B1 | 6/2002 | Weder | |
| 6,640,991 | B1 | 11/2003 | Amanat | |
| 6,749,551 | B2 | 6/2004 | Metzler | |
| 7,128,798 | B2 | 10/2006 | Boudouris | |
| 7,178,185 | B1 * | 2/2007 | Nattler | A41D 15/04 2/84 |
| 8,556,876 | B2 | 10/2013 | Beckman | |
| 9,062,222 | B2 | 6/2015 | Nilsson | |
| 9,305,598 | B2 | 4/2016 | Rossiter | |
| 9,533,786 | B1 * | 1/2017 | Feinstein | B65D 65/10 |
| 2002/0027138 | A1 | 3/2002 | Hyobu | |
| 2003/0142887 | A1 | 7/2003 | Sleight | |
| 2003/0218525 | A1 | 11/2003 | Sugawara | |
| 2004/0001973 | A1 | 1/2004 | Gao | |
| 2004/0241394 | A1 * | 12/2004 | Burrows | B42D 1/008 428/195.1 |
| 2005/0056655 | A1 | 3/2005 | Gary | |
| 2005/0230465 | A1 | 10/2005 | Metzler | |
| 2005/0242097 | A1 | 11/2005 | Morin | |
| 2005/0285749 | A1 | 12/2005 | Schmidt-Troschke | |
| 2006/0168767 | A1 | 8/2006 | Huang | |
| 2006/0231562 | A1 | 10/2006 | Carroll | |
| 2006/0283750 | A1 | 12/2006 | Villars | |
| 2010/0308039 | A1 | 12/2010 | Miros | |
| 2011/0253571 | A1 | 10/2011 | Rothbaum | |
| 2012/0018428 | A1 | 1/2012 | Norman | |
| 2012/0073242 | A1 | 3/2012 | Nilsson | |
| 2012/0076995 | A1 | 3/2012 | Nilsson | |
| 2012/0103506 | A1 | 5/2012 | Love | |
| 2012/0216374 | A1 | 8/2012 | Manuello | |
| 2013/0032503 | A1 | 2/2013 | Nobile | |
| 2013/0061431 | A1 * | 3/2013 | Naftali | H01F 7/0263 24/303 |
| 2014/0008425 | A1 | 1/2014 | Clark | |
| 2014/0034080 | A1 | 2/2014 | Paquet | |
| 2014/0093299 | A1 | 4/2014 | Lambert | |
| 2015/0023223 | A1 | 1/2015 | Robbins | |
| 2015/0196955 | A1 | 7/2015 | Naftalin | |
| 2015/0305402 | A1 | 10/2015 | Bourgoin | |
| 2016/0039575 | A1 | 2/2016 | Murray | |
| 2016/0095763 | A1 | 4/2016 | Mazor | |
| 2016/0221722 | A1 | 8/2016 | Burke | |
| 2017/0066559 | A1 | 3/2017 | Kim | |
| 2017/0105556 | A1 * | 4/2017 | Tarpey | A47G 9/086 |
| 2017/0159295 | A1 | 6/2017 | Warner | |
| 2017/0275056 | A1 | 9/2017 | Boudouris | |
| 2018/0042403 | A1 | 2/2018 | Storace | |
| 2018/0339806 | A1 | 11/2018 | Sugita | |
| 2019/0133281 | A1 * | 5/2019 | Munie | A45C 3/001 |
| 2020/0055636 | A1 | 2/2020 | Hochberg | |
| 2020/0055659 | A1 | 2/2020 | Hochberg | |
| 2020/0058430 | A1 | 2/2020 | Hochberg | |

FOREIGN PATENT DOCUMENTS

| | | | | |
|---|---|---|---|---|
| CN | 205998313 | U | | 3/2017 |
| DE | 202009000499 | U1 | | 3/2009 |
| EP | 741555 | B1 | | 12/1997 |
| EP | 665737 | | | 12/1998 |
| EP | 1683736B1 | B1 | | 3/2010 |
| EP | 1507659 | B1 | | 2/2011 |
| EP | 3038938 | B1 | | 10/2018 |
| EP | 2935029 | B1 | | 2/2019 |
| EP | 3123489 | B1 | | 5/2019 |
| FR | 2680761A1 | A1 | | 3/1993 |
| GB | 1121773 | A | | 7/1968 |
| JP | 2010046152 | A | * | 3/2010 |
| JP | 2010223107 | A | * | 10/2010 |
| JP | 2012101848 | A | * | 5/2012 |
| JP | 2015020779 | A | | 2/2015 |
| JP | 2018038596 | A | * | 3/2018 |
| WO | WO2006135313 | A1 | | 12/2006 |
| WO | WO2014096427 | A1 | | 6/2014 |
| WO | WO2015132025 | A1 | | 9/2015 |
| WO | WO2016139170 | A1 | | 9/2016 |
| WO | WO2017002139 | A1 | | 1/2017 |
| WO | WO201721398 | A1 | | 2/2017 |
| WO | WO2017172542 | A1 | | 10/2017 |

OTHER PUBLICATIONS

International Search Report and Written Opinion dated Oct. 18, 2019, PCT/US2019/045595, 12 pgs.

International Search Report and Written Opinion dated Oct. 18, 2019, PCT/US2019/045596, 12 pgs.

International Search Report and Written Opinion dated Oct. 23, 2019, PCT/US2019/045597, 12 pgs.

All Office Actions; U.S. Appl. No. 16/535,118.

All Office Actions; U.S. Appl. No. 16/535,119.

* cited by examiner

CONFORMABLE PACKAGE

FIELD OF THE INVENTION

Embodiments of the technology relate, in general, to packaging having magnetically engaging portions and conformable opening states.

BACKGROUND OF THE INVENTION

Packaging for containing dispensable items finds use in a wide variety of consumer and business products. Often such packaging is intended to contain products that can be removed and consumed in partial quantities, leaving the package partially filled. Some products are packaged and used in a manner that require one-handed opening. Being able to effectively open or close a package using one hand can be challenging. For example, flexible packaging with "zipper" type closures are difficult to open or close with one hand.

There remains an unmet need, therefore, for packaging that permits effective one-handed closure of a package.

Further, there remains an unmet need for flexible packaging that permits effective one-handed opening and closure of an opening of the package.

DETAILED DESCRIPTION OF THE INVENTION

Figure 1:
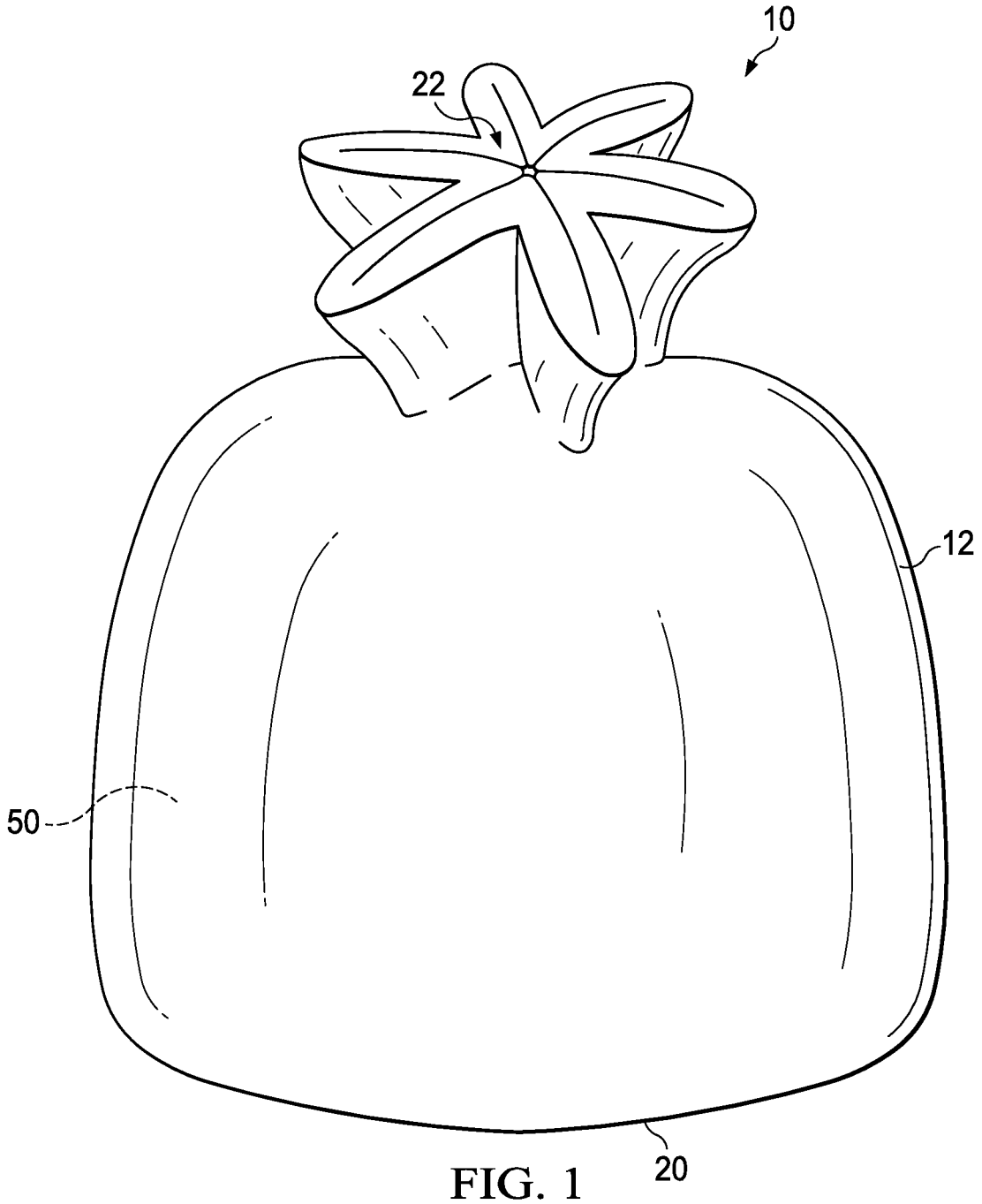
FIG. 1 is a perspective view of an embodiment of a package of the disclosure.

Certain embodiments are hereinafter described in detail in connection with the views and examples of FIGS. 1-7, wherein like numbers refer to like elements throughout the views.

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific FIG. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

The present disclosure relates generally to packaging having an opening through which items can be removed or dispensed. The packaging can be flexible packaging, such as pouches, bags and boxes, which can be made of flexible materials such as polymer films, foil films, laminates, and the like. The flexible packaging can contain and dispense solid items, or fluid contents, or other fluent items such as powders, and like items. In general, non-limiting embodiments of packaging are disclosed herein as flexible packaging. Flexible packaging can include, for example, polymeric sidewalls and can be in the form of formable bags or pouches.

In embodiments, the closing features disclosed herein can include magnetic regions under mutual magnetic attraction.

The magnetic regions of the flexible packaging can be magnets and can be disposed on two or more sidewalls of the flexible packaging in a manner in which they are mutually attracted to draw the sidewalls into at least partial contacting relationship. In embodiments, the magnetic regions can be the result of a magnetized material such as a magnetizable ink that has been deposited in a predetermined pattern on sidewalls of the flexible packaging, cured (if necessary), and magnetized. In an embodiment, the magnetizable material can be a UV-curable magnetic ink. In an embodiment, the magnetizable material can be a magnetic ink magnetized by a process utilizing pairs of mating magnetic arrays in which the magnetic ink is deposited, such as by printing, onto a flexible web substrate and passed through the gap between the mating magnetic arrays. In an embodiment, the flexible web substrate can contact one of the magnetic arrays.

In an embodiment, an apparatus and method for magnetizing a magnetizable material into patterns of alternating, generally parallel north and south poles on a flexible web substrate is referred to as a Hybrid Magnetization Process and is disclosed in co-owned, U.S. Pat. Ser. No. 62/718,402 which was filed on the same day as the present disclosure in the name(s) of Scott David Hochberg, and which is hereby incorporated herein by reference.

In an embodiment, a magnetizable material can be deposited, such as by printing or extrusion, onto a polymeric web substrate. Further, the magnetizable material and/or the web substrate having deposed thereon the magnetizable material can be generally planar and continuous on at least two parallel surfaces. In an embodiment, the magnetizable material comprises a magnetic ink available from ACTEGA North America, Delran, N.J., and can comprise a substrate, a primer and magnetic ink. A water-based adhesion assisting primer can be deposited and cured on a substrate, such as a polymer film. A magnetic ink can be deposited on top of the substrate and cured using a UV light source. The magnetic ink can comprise monomers, oligomers, photoinitiators and isotropic neodymium iron boron particles. Multiple layers of the magnetic ink can be used to increase the amount of magnetizable material on the substrate.

Figure 2:
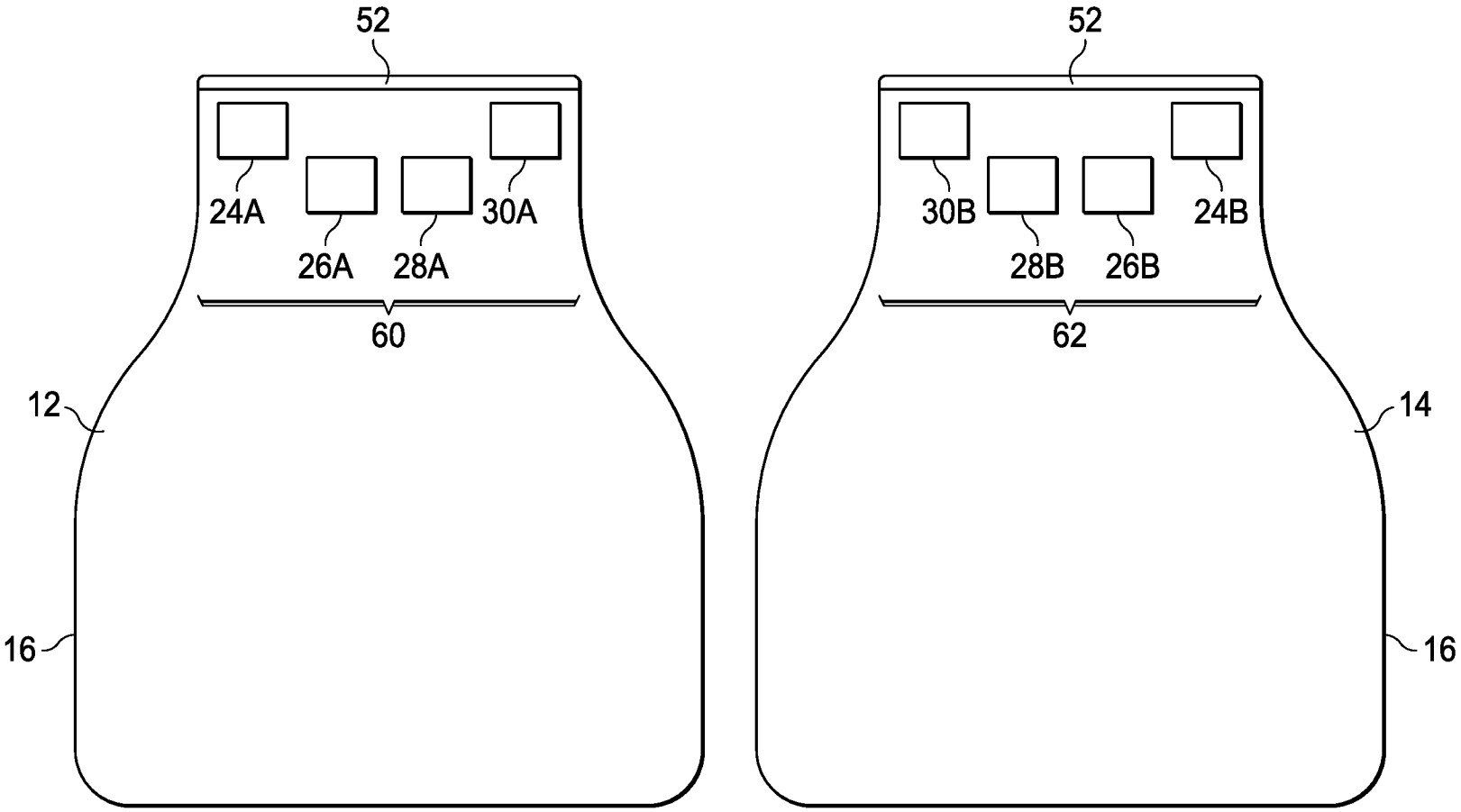
FIG. 2 is a side view of a portion of a package of the disclosure.
Figure 3:
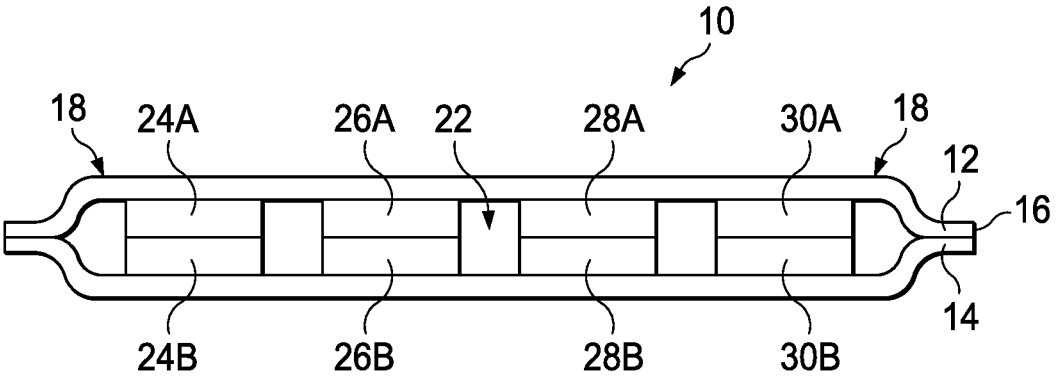
FIG. 3 is a top view of a portion of a package of the disclosure

Referring to FIG. 1, there is shown an example of a package 10, which can be a flexible package 10 for dispensing items contained in the package. The flexible package 10 can have a first major sidewall 12 and a second major sidewall 14 (not shown, but opposite the first major sidewall, as depicted in FIGS. 2 and 3). The first and second major sidewalls 12, 14 can each have an outside perimeter 16. The first and second major sidewalls 12, 14 can be generally the same size and shape and can be joined at their respective perimeters 16. In an embodiment the major sidewalls 12, 14 can be joined together, such as by adhesive, welding, crimping, or the like to each other at the perimeter 16 to form a container, such as a pouch, having generally two sides enclosing an interior compartment 50 and a bottom portion 20 and an opening 22, which is generally understood to be a top opening in use. The interior compartment can be closed when opening 22 is closed, or can have fluid communication with the exterior portions when opening 22 is open.

In FIG. 1 opening 22 is shown in one example embodiment of a closed position and exhibits six petals 18. "Petals" as used herein refers to the laterally extending closure folds at the opening 22 of package 10. Petals are the result of the structural configuration of magnetic regions at the opening 22, as discussed more fully below. In general, a package 10 of the present disclosure can have M petals, where M is an integer. It is believed that in practice M can advantageously be from 2 to 8. In FIG. 1 M=6.

The flexible packaging can have one or more minor sidewalls that can be relatively smaller in size and shape than the major sidewalls and can join the major sidewalls 12, 14 together with a bottom portion 20 to form a package 10 in the form of a bag, which can be a flexible polymeric bag, having an opening 22, which is generally understood to be a top opening in use. Minor sidewalls can be gusseted to facilitate package deformation, including folding. In an embodiment the major sidewalls 14, 16 can be joined together, such as by adhesive, welding, crimping, or the like to minor sidewalls and the bottom portion 20. In general, any number of sidewalls can be utilized, but for simplicity, the invention is disclosed herein as having two sidewalls joined about their respective peripheries and forming an opening. Further, the term "sidewall" is not to be taken as suggesting any degree of flatness, shape, size, or thickness.

The flexible package 10 can have N magnetic regions disposed in opposing relationship on at least each of the first and second major sidewalls 14 and 16, where N can be a positive integer between 4 and 16, and can be, as illustrated, an even integer. In general, at least one pair of opposing magnetic regions can be disposed in operatively magnetic attraction on the major sidewalls to effect variable volume of the closed package or variable change to the opening shape, as disclosed more fully below. Magnetic regions can be achieved on packaging, including flexible packaging, by the aforementioned Hybrid Magnetization Process.

In an embodiment, as shown in FIG. 2, four magnetic regions (N=4) 24-30 on each of two opposing major sidewalls 12, 14, can be utilized. For clarity, the magnetic regions on first sidewall 12 will be referred to with an "A" suffix, and magnetic regions on second sidewall 14 will be referred to with a "B" suffix. The illustrations of FIGS. 2 and 5 can be considered to be viewing the major sidewalls 12, 14 if package 10 as shown in FIG. 1 was opened up and the sidewalls separated and flattened. In each of FIGS. 2 and 5 the face of each sidewall 12, 14 closest to the viewer as depicted can be either an external face (i.e., on the outside of package 10), or an internal face (i.e., on the inside of package 10). As can be understood, therefore, magnetic regions can be disposed either on the outside of package 10 or the inside of package 10. Likewise, magnetic regions can be disposed in the interior of a laminate material used for package 10.

Figure 4:
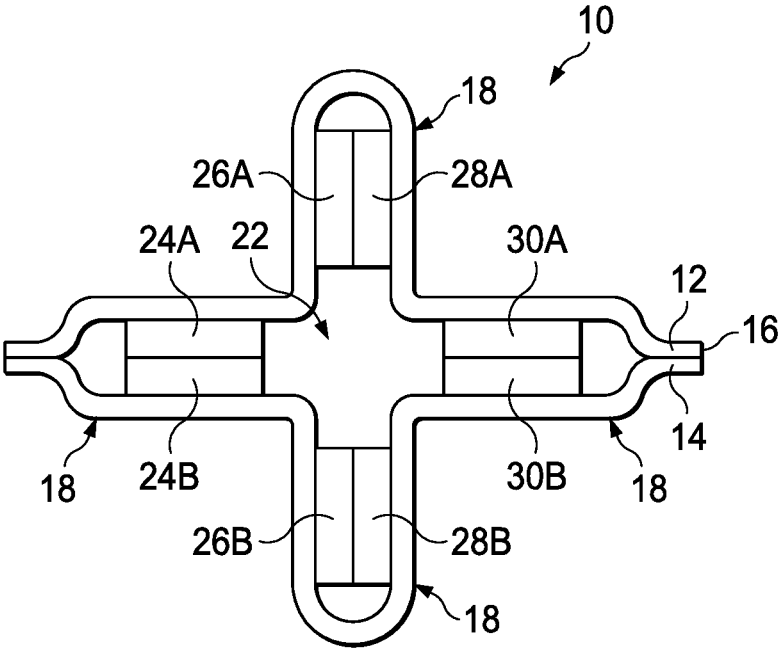
FIG. 4 is a top view of a portion of a package of the disclosure.

In general, a plurality of magnetic regions can be distributed near opening 22 on package 10. In the illustrated non-limiting embodiments, FIGS. 2-4 show four magnetic regions distributed in a spaced relationship near the opening area of each sidewall shown, and FIGS. 5-8 show three magnetic regions distributed in a spaced relationship near the opening area of each sidewall. In general, the number and spacing S of magnetic regions can be selected for sufficient closure properties depending on the desired number M of potential petals, the strength of the magnetic force of the magnetic regions, the size of the package, the shape of the package, the stiffness of the package material, and any other physical properties that affect the ability of the package to have variable volume when closed as disclosed herein. In an embodiment, the entire face of each major sidewall 12, 14 can be a magnetic region.

FIGS. 2-4 show various non-limiting examples of magnetic regions as can be practiced in accordance with the present disclosure. In each of FIGS. 2-4 first major sidewall 12 is shown on the left, and second major sidewall 14 is shown on the right.

As shown in FIG. 2, first major sidewall 12 can have disposed thereon in a spaced relationship a first plurality of magnetic regions 60 comprising four discrete magnetic regions: first discrete magnetic region 24A, a second discrete magnetic region 26A, a third discrete magnetic region 28A, and a fourth discrete magnetic region 30A. Likewise, second major sidewall 14 can have disposed thereon in a spaced relationship a second plurality of magnetic regions 62 comprising four opposed discrete magnetic regions: first opposed magnetic region 24B, a second opposed magnetic region 26B, a third opposed magnetic region 28B, and a fourth opposed magnetic region 30B.

In general, all of the magnetic regions on sidewall 12 can be referred to as a first plurality of magnetic regions 60, and all of the magnetic regions on sidewall 14 can be referred to as a second plurality of magnetic regions 62. In general, a first plurality of magnetic regions 60 and second plurality of magnetic regions 62 can be magnetically engageable with a separable magnetic force to close the access opening 22 of the package 10. In general, the first plurality of magnetic regions can comprise generally evenly spaced apart discrete magnetic regions and the second plurality of magnetic regions can comprise generally evenly spaced apart discrete opposed magnetic regions.

Magnetic regions can be sized according to the size and shape of the package 10 and their respective forces of attraction. Magnetic regions can comprise magnetized magnetic ink that can be printed onto a region of the package and sized and shaped according to the requirements of the particular packaging task. Magnetic regions can be flexible, and can be as flexible as the material of the sidewall 12, 14. Magnetic regions can comprise magnetic ink deposited, such as by printing, in a relatively thin layer, such that the portions of sidewalls 12 and 14 comprising magnetic regions can be generally flexible, and can be flexibly magnetically attracted to one another.

The advantages of the example embodiment of FIG. 2 can be illustrated by the top views of FIGS. 3 and 4 which show two different closure configurations, respectively. It can be understood that the representation is schematic, and that the FIGS. are not to be taken as representing true dimensions. For example, magnetic regions can be relatively thin, printed elements, and sidewalls can be thin-film polymers. Thus, for illustrative purposes, the thickness off both the magnetic regions and the sidewalls is exaggerated in FIGS. 3 and 4. Further in general, pairs of discrete magnetic regions and opposing discrete magnetic regions, e.g., magnetic regions 26A and 26B of FIG. 2, can mirror one another in shape, size and position, and can be disposed opposite one another in the package 10. In general, magnetic regions can, when in a magnetically contacting state effect closure of the flexible package 10, as depicted in FIG. 1.

As shown in FIG. 3, in one closure configuration, opening 22 can be closed in a relatively flat manner, in which case according to the present disclosure, the opening would exhibit two petals 18 (M=2). As shown, each of the discrete magnetic regions of first plurality of magnetic regions 60 finds a one-to-one corresponding, opposing discrete magnetic region of second plurality of magnetic regions 62. In use, due to the relatively thin, flexible nature of both the sidewalls 12 and 14, as well as the relatively thin, flexible nature (or embedded in a laminate film), of the magnetic regions, the closure configuration shown in FIG. 3 can effect substantially complete closure of package 10 at opening 22.

As shown in FIG. 4, in one closure configuration, opening 22 can be closed in a different manner (than that depicted in FIG. 3), in which case according to the present disclosure, the opening would exhibit four petals 18 (M=4). As shown, some of the discrete magnetic regions of first plurality of magnetic regions 60 can be magnetically engageable with a separable magnetic force to other discrete magnetic regions of the first plurality of magnetic regions, e.g., 26A and 28A, and some of the discrete magnetic regions of first plurality of magnetic regions 60 can be magnetically engageable with a separable magnetic force to discrete magnetic regions of the second plurality of magnetic regions, e.g., 30A and 30B. In use, due to the relatively thin, flexible nature of both the sidewalls 12 and 14, as well as the relatively thin, flexible nature (or due to being embedded in a laminate film), of the discrete magnetic regions, the closure configuration shown in FIG. 3 can effect substantially complete closure of package 10 at opening 22.

As can be understood, the embodiment shown in FIG. 2 can be closed in at least two different configurations, e.g., either a two-petal or four-petal configuration. An advantage to this closure feature is that the package 10 can be opened or closed with one hand by a user. For example, with respect to the closure configuration of FIG. 4, it can be understood that this configuration can be achieved by a user's fingers of one hand grasping the open opening 22 and "bunching up" the closure with fingers forcing the magnetic regions into proximity so that they can be come magnetically engageable with a separable magnetic force to close the access opening 22 of thee package 10. Such a closure can also be easily opened with one hand, by, for example, forcing ones fingers into the opening and using the fingers to spread apart the separable magnetically engaged magnets of the discrete magnetic regions.

Further, as can be understood, the embodiment discussed with respect to FIGS. 2-4 can be extrapolated to have N magnetic regions disposed in opposing relationship on at least each of the first and second major sidewalls 14 and 16, where N can be an even integer greater than 4. Taking the description of FIGS. 2-4, for example, but considering that each sidewall 12, 14 can have six (N=6) discrete magnetic regions (or opposed discrete magnetic regions) per each plurality of magnetic regions, one can see that closing could result in a flat configuration like that of FIG. 3 having two petals, or a multi-petal configuration like that of FIG. 4, but with six petals (M=6).

Figure 5:
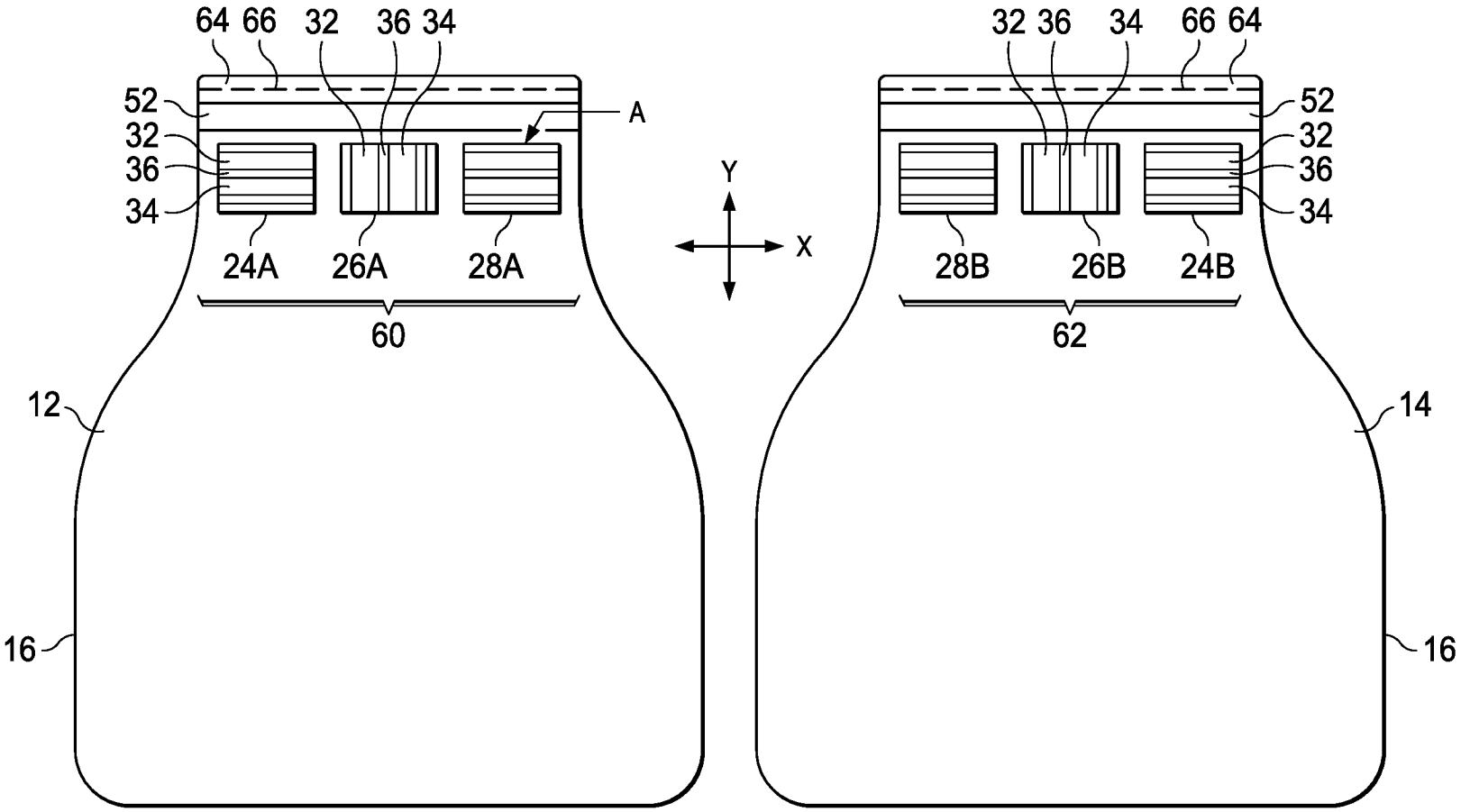
FIG. 5 is a side view of a portion of a package of the disclosure.

Discrete magnetic regions can each comprise a pattern of alternating north pole bands 32 and south pole bands 34 of magnetized material, as shown in FIG. 5. The bands 32 and 34 can be separated by neutral zones 36 and can produce a magnetic flux. The magnetic flux is the integral of the normal component of the magnetic field passing through a defined surface. For printed magnets, that surface is planar to the working face of the magnetized material. In general, the magnetic pole bands can be in a pattern of continuous stripes of alternating north and poles (and, in embodiments a neutral zone separating adjacent north and south poles), with a predetermined pole density (pole bands per distance) that can be the result of the manufacturing process to produce them. Further, magnetic bands need not be uniform in width and spacing, but can exhibit a pole density gradient, which can be achieved by varying the width of magnetic poles in the direction planar and perpendicular to the pole band. A pole density gradient can produce a magnetic flux gradient, which can be understood as the integral of the normal component of the magnetic field from the magnetized region and which is non-constant at a defined surface. A magnetic flux gradient can be achieved by varying the pole width (poles per inch, or pole density) or magnetic region (e.g., magnetic ink) thickness. Likewise, the bands 32 and 34 need not be continuous in the form of stripes, but can be a band-like feature comprising discrete circular-shaped, oval-shaped, rectangular-shaped, and the like portions of magnetized material.

Magnetic bands of magnetic poles can be produced in processes comprising passing a substrate comprising a magnetizable material through one or more pairs of magnetic arrays such as flux-pumping arrays, diametric arrays, or the aforementioned Hybrid Magnetization Process. In general, magnetic regions having generally parallel bands of alternating magnetic poles will be most strongly magnetically attracted to other magnetic regions having generally parallel bands of alternating magnetic poles when the poles of each magnetic region are oriented in a parallel manner. Likewise, magnetic regions having generally parallel bands of alternating magnetic poles will be least magnetically attracted to other magnetic regions having generally parallel bands of alternating magnetic poles when the poles of each magnetic region are oriented in a perpendicular manner.

Figure 6:
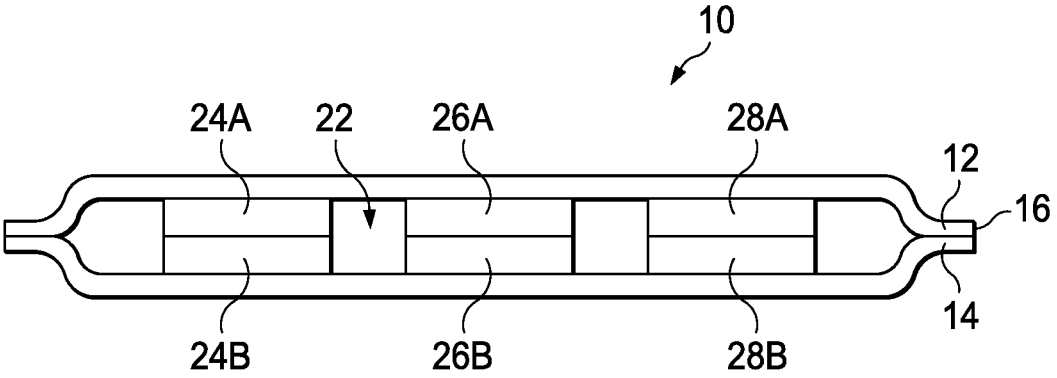
FIG. 6 is a side view of a portion of a package of the disclosure.
Figure 7:
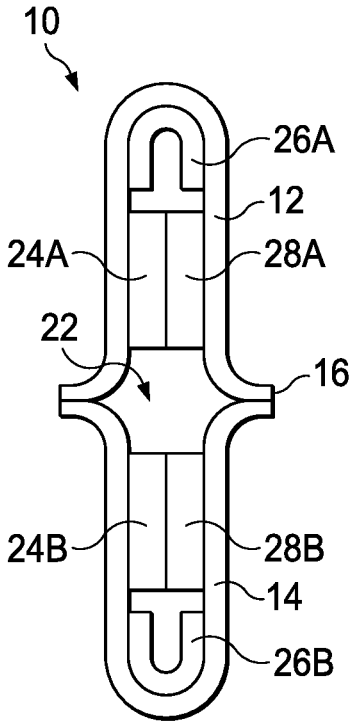
FIG. 7 is a top view of a portion of a package of the disclosure.

In an example embodiment shown in FIGS. 5-7, a package closure configuration is illustrated in which the design takes advantage of the differing magnetic attractions of discrete magnetic regions having differing orientations of their generally parallel bands of alternating magnetic poles.

In the illustrated embodiment, each sidewall 12, 14, can have L discrete magnetic regions, and L opposed magnetic regions, where L is a positive integer greater than 3. In an embodiment, some of the discrete magnetic regions comprise a plurality of bands of north and south poles having a first directional orientation, and some of the opposed discrete magnetic regions comprise a plurality of bands of north and south poles having a second directional orientation. In an embodiment, the first and second directions can be substantially at right angles relative to one another. For example, in FIG. 5 a representative X-Y plane indicated for the purpose of understanding magnetic band orientation as disclosed herein, with each magnetic band being considered oriented in line with generally longitudinal central axis A, as indicated in discrete magnetic region 28A in FIG. 5. As shown, sidewall 12 can have a first plurality of three discrete magnetic regions 60 (L=3) comprising a first discrete magnetic region 26A and third discrete magnetic region 28A each having generally parallel bands of alternating magnetic poles oriented in the X-direction as shown in FIG. 5, and which are at substantially right angles to those of second discrete magnetic region 26A, which is oriented in the Y-direction. The first, second, and third opposed discrete magnetic regions 24B, 26B, and 28B (L=3) of a second plurality of magnetic regions 62 on sidewall 14 can be substantially a mirror image of discrete magnetic regions and magnetic pole orientations of first plurality of magnetic regions 60.

With this structure of magnetic regions shown in FIG. 5, at least two different closure configurations can be achieved. In FIG. 6, which is a schematic top view of a closed package 10 having the magnetic region structure of FIG. 5, the closure can be a two-petal, relatively flat closure. Discrete magnetic region 24A and opposed discrete magnetic region 24B, each having the same relative orientation of magnetic poles 32, 34, can be magnetically attracted and exhibit separable magnetically engaged contact to effectively close the portion of package 10 in the vicinity of the magnetic regions. The same description can be applied to discrete magnetic region 26A and opposed discrete magnetic region 26B, as we all as magnetic regions 28A and 28B. In general, any number of similarly paired discrete magnetic regions can be utilized, and depending on the size and shape of package 10, can effectively close opening 22 of package 10 in a configuration as shown in FIG. 6.

Package 10 utilizing a magnetic region arrangement as shown in FIG. 5 can also be closed in an alternative configuration, as depicted schematically in FIG. 7. In FIG. 7, which is a schematic top view of a closed package 10 having the magnetic region structure of FIG. 5, the closure can be an alternative two-petal, relatively flat closure. Discrete magnetic regions 24A and 28A, each having the same relative orientation of magnetic poles 32, 34, can be magnetically attracted and exhibit separable magnetically engaged contact to effectively close the portion of package 10 in the vicinity of the magnetic regions. The same description can be applied to opposed discrete magnetic regions 24B and 28B. In this configuration, magnetic regions 26A and 26B can a role in effecting closure of the "petal-tip) portion of the closure of opening 22 on package 10. In general, any number of similarly paired magnetic regions can be utilized, and depending on the size and shape of package 10, can effectively close opening 22 of package 10 in a configuration as shown in FIG. 7.

As discussed above, it is understood that the representation of FIGS. 6 and 7 is schematic, and that the FIGS. are not to be taken as representing true dimensions. For example, discrete magnetic regions can be relatively thin, printed regions, and sidewalls can be thin-film polymers. Thus, for illustrative purposes, the thickness off both the magnetic regions and the sidewalls is exaggerated in FIGS. 6 and 7.

The bands of magnetized poles in each discrete magnetic region can be oriented parallel to, perpendicular to, or at an angle with respect to the overall orientation of a package or package opening 22, or with respect to other magnetic regions. In the embodiment of FIG. 2, for example, all magnetic poles in all magnetic regions can have the same angle relative to each other. However, in the embodiment of FIG. 5, for example, north poles mate with south poles by having the poles contact at the same angle relative to each other. There may relatively little attraction at 90 degrees relative to each other and the attractive force can increase as the change in pole degree nears 0 (or 180) degrees. In an embodiment, opposing magnetic regions mirror one another, so that the size, shape and placement of discrete magnetic regions can have the same size, shape and placement as corresponding opposed discrete magnetic regions 28 and 30.

In general, the discrete magnetic regions can be disposed on either side of sidewalls 12 and 14, respectively. As can be understood, in a flexible package 10, the magnetic regions can be disposed on the interior of the flexible package 10, or on the exterior of flexible package 10. In an embodiment, one or more of the magnetic regions can be disposed on the interior of the flexible package 10, and the one or more magnetic regions can be disposed on the outside of the flexible package 10. By placing the magnetic regions on one side or the other of the sidewalls, magnetic attracting force can be affected, either increasing or decreasing the magnetic force as desired. Likewise, if magnetic ink is utilized, the magnetic ink can be applied in a pattern and can include colors, such that the magnetic regions can be visibly incorporated into the flexible package print design.

The flexible package 10 need not have any specific shape, and the shapes illustrated are non-limiting examples only. Additional features useful in the packaging art can be incorporated. For example, package 10 can have disposed on one or both of major sidewalls 12, 14 an additional closure mechanism 52, as shown in FIG. 5. Closure mechanism 52 can be any of known mechanisms for closure of packaging, including a zip track closure with a slider zip closure. Closure mechanism can also be a separate magnetic region of the type disclosed herein. Closure mechanism 52 can also comprise, or work in conjunction with, a frangible portion 64 that can serve to provide complete sealing of package 10 during shipping and storage, but which can be removed prior to use to open package 10. Frangible portion 64 can include a line of weakness 66, such as a perforated line, that can be torn off to open package 10.

In general, embodiment of the package 10 disclosed herein can also include indicia or graphics on the exterior sidewalls that display and direct the consumer to conformable or foldable arrangements to the package and how to manipulate the package to manipulate the volume or shape. The graphics can communicate how the package is manipulated based on the magnet placement.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated.

The scope is, of course, not limited to the examples set forth herein, but can be employed in any number of applications and equivalent devices by those of ordinary skill in the art. Rather it is hereby intended the scope of the invention to be defined by the claims appended hereto.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A flexible package, the package comprising:

a first flexible polymeric sidewall having a first perimeter and a second flexible polymeric sidewall having a second perimeter, the first and second flexible polymeric sidewalls being joined by a bottom portion and first and second seams that define first and second sides, respectively;

an access opening opposite the bottom portion;

a first plurality of magnetic regions disposed on the first sidewall near the access opening, the first plurality of magnetic regions comprising at least N discrete magnetic regions, where N is an even integer from 4 to 16;

a second plurality of magnetic regions disposed on the second sidewall near the access opening, the second plurality of magnetic regions comprising at least N opposed discrete magnetic regions, the second plurality of magnetic regions being opposite the first plurality of magnetic regions; and wherein the N discrete magnetic regions and the N opposed discrete magnetic regions are magnetically engageable with a magnetic force to close the access opening of the package in a configuration having M petals, where M is selected from the integers consisting of 4, 6, and 8.

2. The polymeric package of claim 1, wherein the discrete magnetic regions and the discrete opposed magnetic regions comprise a magnetic ink.

3. The flexible package of claim 1, wherein the first plurality of magnetic regions comprises evenly spaced apart discrete magnetic regions and the second plurality of magnetic regions comprises evenly spaced apart discrete opposed magnetic regions.

4. The flexible package of claim 1, wherein the discrete magnetic regions and the discrete opposed magnetic regions comprise a plurality of parallel spaced apart magnetic bands of alternating north and south poles.

5. The flexible package of claim 1, wherein the discrete magnetic regions and the discrete opposed magnetic regions comprise a plurality of parallel spaced apart magnetic bands of alternating north and south poles, and each of the bands of alternating north and south poles are oriented in a same direction.

6. The flexible package of claim 1, wherein the discrete magnetic regions and the discrete opposed magnetic regions comprise a plurality of parallel spaced apart magnetic bands of alternating north and south poles, with the adjacent north and south poles being separated by a neutral zone.

7. A flexible package, the package comprising:

a first flexible polymeric sidewall having a first perimeter and a second flexible polymeric sidewall having a second perimeter, the first and second flexible polymeric sidewalls being joined by a bottom portion and first and second seams that define first and second sides, respectively;

an access opening opposite the bottom portion;

a first plurality of magnetic regions disposed on the first sidewall near the access opening, the first plurality of magnetic regions comprising at least N discrete magnetic regions, where N is an even integer between 4 and 10, and wherein each discrete magnetic region comprises a plurality of bands of north and south poles;

a second plurality of magnetic regions disposed on the second sidewall near the access opening, the second plurality of magnetic regions comprising at least N opposed discrete magnetic regions, the second plurality of magnetic regions being opposite the first plurality of magnetic regions, and wherein each discrete opposed magnetic region comprises a plurality of bands of north and south poles; and wherein the N discrete magnetic regions and the N opposed discrete magnetic regions are magnetically engageable with a magnetic force to close the access opening of the package in a configuration having M petals, where M is selected from the integers consisting of 3, 4, 6, and 8.

8. The flexible package of claim 7, wherein the discrete magnetic regions and the discrete opposed magnetic regions comprise a UV-curable magnetic ink.

9. The flexible package of claim 7, wherein the first plurality of magnetic regions comprises evenly spaced apart discrete magnetic regions and the second plurality of magnetic regions comprises evenly spaced apart discrete opposed magnetic regions.

10. The flexible package of claim 7, wherein the discrete magnetic regions and the discrete opposed magnetic regions comprise a plurality of parallel spaced apart magnetic bands of alternating north and south poles, and each of the bands of alternating north and south poles are oriented in a same direction.

11. The flexible package of claim 7, wherein adjacent north and south poles are separated by a neutral zone.

12. A flexible package, the package comprising:

a first flexible polymeric sidewall having a first perimeter and a second flexible polymeric sidewall having a second perimeter, the first and second flexible polymeric sidewalls being joined by a bottom portion and first and second seams that define first and second sides, respectively;

an access opening opposite the bottom portion;

a first plurality of magnetic regions disposed on the first sidewall near the access opening, the first plurality of magnetic regions comprising at least N discrete magnetic regions, where N is an integer between 3 and 10, and wherein some of the discrete magnetic regions comprise a plurality of bands of north and south poles having a first directional orientation, and some of the discrete magnetic regions comprise a plurality of bands of north and south poles having a second directional orientation;

a second plurality of magnetic regions disposed on the second sidewall near the access opening, the second plurality of magnetic regions comprising at least N opposed discrete magnetic regions, the second plurality of magnetic regions being opposite the first plurality of magnetic regions, and wherein some of the opposed discrete magnetic regions comprise a plurality of bands of north and south poles having a first directional orientation, and some of the opposed discrete magnetic regions comprise a plurality of bands of north and south poles having a second directional orientation; and wherein the N discrete magnetic regions and the N opposed discrete magnetic regions are magnetically engageable with a magnetic force to close the access opening of the package in a configuration having M petals, where M is an integer between 2 and 8.

13. The flexible package of claim 12, wherein the discrete magnetic regions and the discrete opposed magnetic regions comprise a UV-curable magnetic ink.

14. The flexible package of claim 12, wherein the first plurality of magnetic regions comprises evenly spaced apart discrete magnetic regions and the second plurality of magnetic regions comprises evenly spaced apart discrete opposed magnetic regions.

15. The flexible package of claim 12, wherein the discrete magnetic regions and the opposed discrete magnetic regions comprise substantially the same size and shape.

16. The flexible package of claim 12, wherein the discrete magnetic regions and the opposed discrete magnetic regions comprise a plurality of parallel spaced apart magnetic bands of alternating north and south poles, and each of the bands of alternating north and south poles are oriented in a same direction.

17. The flexible package of claim 12, wherein the discrete magnetic regions and the opposed discrete magnetic regions comprise a plurality of parallel spaced apart magnetic bands of alternating north and south poles, and wherein adjacent north and south poles are separated by a neutral zone.

18. The flexible package of claim 12, wherein the first directional orientation is at right angles to the second directional orientation.

* * * * *